US011965402B2

(12) United States Patent
Brown et al.

(10) Patent No.: US 11,965,402 B2
(45) Date of Patent: Apr. 23, 2024

(54) ELECTRIC SUBMERSIBLE PUMP (ESP) SHROUD SYSTEM

(71) Applicant: Halliburton Energy Services, Inc., Houston, TX (US)

(72) Inventors: Donn J. Brown, Tulsa, OK (US); Ketankumar Kantilal Sheth, Tulsa, OK (US); Andre Joseph Bernier, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/954,849

(22) Filed: Sep. 28, 2022

(65) Prior Publication Data

US 2024/0102365 A1 Mar. 28, 2024

(51) Int. Cl.
*E21B 43/38* (2006.01)
*E21B 43/12* (2006.01)

(52) U.S. Cl.
CPC ..... *E21B 43/128* (2013.01); *E21B 43/38* (2013.01)

(58) Field of Classification Search
CPC ..... E21B 43/128; E21B 43/38
USPC ..... 166/369
See application file for complete search history.

(56) References Cited

U.S. PATENT DOCUMENTS 3,195,661 A 7/1965 Jackson et al.
4,187,912 A 2/1980 Cramer
4,481,020 A 11/1984 Lee et al.
4,901,413 A 2/1990 Cotherman et al.
4,913,630 A 4/1990 Cotherman et al.
5,207,810 A 5/1993 Sheth
5,431,228 A 7/1995 Weingarten et al.
5,525,146 A 6/1996 Straub
(Continued)

FOREIGN PATENT DOCUMENTS

CN 106076006 A 11/2016
CN 205965282 U 2/2017
(Continued)

OTHER PUBLICATIONS

Schlumberger Oilfield Glossary entry for "slug flow", accessed Sep. 8, 2023 via glossary.slb.com.
(Continued)

*Primary Examiner* — William D Hutton, Jr.
*Assistant Examiner* — Ashish K Varma
(74) *Attorney, Agent, or Firm* — Conley Rose, P.C.; Rodney B. Carroll

(57) ABSTRACT

An electric submersible pump (ESP) assembly. The ESP assembly comprises an electric motor; a seal section coupled to the electric motor; a fluid intake coupled to an uphole end of the seal section, wherein the fluid intake defines a plurality of inlet ports; a gas separator comprising a plurality of gas phase discharge ports, and at least one liquid phase discharge port, wherein the gas separator is located uphole of the fluid intake; a centrifugal pump comprising a fluid inlet at a downhole end, wherein the at least one liquid phase discharge port of the gas separator is fluidically coupled to the fluid inlet of the centrifugal pump; and an inverted shroud assembly, wherein a downhole end of the inverted shroud assembly is coupled to an outside of the gas separator downhole of the gas phase discharge ports of the gas separator and uphole of the fluid intake.

13 Claims, 10 Drawing Sheets

(56) References Cited

U.S. PATENT DOCUMENTS

| | | | | |
|---|---|---|---|---|
| 6,066,193 | A * | 5/2000 | Lee | E21B 43/38 96/216 |
| 6,113,675 | A | 9/2000 | Branstetter | |
| 6,155,345 | A | 12/2000 | Lee et al. | |
| 6,382,317 | B1 | 5/2002 | Cobb | |
| 6,412,562 | B1 | 7/2002 | Shaw | |
| 6,705,402 | B2 | 3/2004 | Proctor | |
| 7,461,692 | B1 | 12/2008 | Wang | |
| 7,462,225 | B1 | 12/2008 | Ketter et al. | |
| 7,766,081 | B2 | 8/2010 | Brown et al. | |
| 7,806,186 | B2 * | 10/2010 | Brown | F04D 29/708 166/309 |
| 8,079,418 | B2 | 12/2011 | Brown et al. | |
| 8,955,598 | B2 * | 2/2015 | Brown | E21B 43/38 417/424.2 |
| 9,283,497 | B2 | 3/2016 | Wang et al. | |
| 10,378,322 | B2 | 8/2019 | Ejim et al. | |
| 10,408,035 | B2 | 9/2019 | Kennedy et al. | |
| 11,149,535 | B2 | 10/2021 | Brown et al. | |
| 11,624,269 | B2 | 4/2023 | Sheth et al. | |
| 11,661,828 | B2 | 5/2023 | Conrad et al. | |
| 2002/0153141 | A1 | 10/2002 | Hartman et al. | |
| 2002/0174982 | A1 | 11/2002 | Weingarten | |
| 2003/0111230 | A1 | 6/2003 | Olson et al. | |
| 2004/0031608 | A1 | 2/2004 | Hall et al. | |
| 2009/0065202 | A1 | 3/2009 | Brown et al. | |
| 2009/0194295 | A1 * | 8/2009 | Thompson | E21B 43/38 166/66.4 |
| 2010/0147514 | A1 | 6/2010 | Swaringin | |
| 2010/0319926 | A1 | 12/2010 | Reid | |
| 2011/0162832 | A1 | 7/2011 | Reid | |
| 2012/0012332 | A1 | 1/2012 | Rooks | |
| 2012/0073800 | A1 | 3/2012 | Janitz | |
| 2013/0068455 | A1 | 3/2013 | Brown et al. | |
| 2014/0174734 | A1 | 6/2014 | Gill et al. | |
| 2015/0192141 | A1 | 7/2015 | Nowitzki et al. | |
| 2016/0130922 | A1 | 5/2016 | Wilson et al. | |
| 2016/0130923 | A1 | 5/2016 | Nowitzki et al. | |
| 2016/0201444 | A1 | 7/2016 | Hardee et al. | |
| 2016/0312590 | A1 | 10/2016 | Chang et al. | |
| 2017/0081952 | A1 | 3/2017 | Osborne et al. | |
| 2019/0162063 | A1 | 5/2019 | Brown et al. | |
| 2019/0234193 | A1 * | 8/2019 | Fehri | E21B 43/128 |
| 2019/0316452 | A1 | 10/2019 | Brown et al. | |
| 2020/0141223 | A1 | 5/2020 | Brown et al. | |
| 2020/0362649 | A1 | 11/2020 | Brown et al. | |
| 2022/0065090 | A1 | 3/2022 | Ejim | |
| 2023/0010704 | A1 | 1/2023 | Sheth et al. | |
| 2023/0014297 | A1 | 1/2023 | Brown et al. | |
| 2023/0105823 | A1 | 4/2023 | Brown et al. | |
| 2023/0111850 | A1 | 4/2023 | Sheth et al. | |
| 2023/0220751 | A1 | 7/2023 | Sheth et al. | |

FOREIGN PATENT DOCUMENTS

| | | | |
|---|---|---|---|
| WO | 2017053624 | A1 | 3/2017 |
| WO | 2020072078 | A1 | 4/2020 |
| WO | 2023282919 | A1 | 1/2023 |
| WO | 2023282920 | A1 | 1/2023 |

OTHER PUBLICATIONS

Office Action dated Sep. 14, 2023 (42 pages), U.S. Appl. No. 17/369,526, filed Jul. 7, 2021.

Foreign Communication from Related Application—International Search Report and Written Opinion of the International Searching Authority, International Application No. PCT/US2023/025736, dated Oct. 17, 2023, 11 pages.

First Office Action dated Aug. 17, 2023 (51 pages), U.S. Appl. No. 17/492,227, filed Oct. 1, 2021.

First Office Action dated Jun. 8, 2023 (34 pages), U.S. Appl. No. 17/737,148, filed May 5, 2022.

Foreign Communication from Related Application—International Search Report and Written Opinion of the International Searching Authority, International Application No. PCT/US2020/022038, dated Nov. 27, 2020, 13 pages.

Foreign Communication from Related Application—International Search Report and Written Opinion of the International Searching Authority, International Application No. PCT/US2021/042395, dated Mar. 25, 2022, 14 pages.

Foreign Communication from Related Application—International Search Report and Written Opinion of the International Searching Authority, International Application No. PCT/US2021/042389, dated Apr. 4, 2022, 11 pages.

Foreign Communication from Related Application—International Search Report and Written Opinion of the International Searching Authority, International Application No. PCT/US2023/013758, dated Jun. 9, 2023, 10 pages.

Office Action dated Nov. 10, 2022 (25 pages), U.S. Appl. No. 17/369,511, filed Jul. 7, 2021.

Office Action dated Jan. 3, 2023 (50 pages), U.S. Appl. No. 17/369,526, filed Jul. 7, 2021.

Office Action dated Mar. 31, 2023 (37 pages), U.S. Appl. No. 17/492,230, filed Oct. 1, 2021.

Filing Receipt, Specification and Drawings for U.S. Appl. No. 17/954,855, filed Sep. 28, 2022, entitled "Electric Submersible Pump (ESP) Assembly Fluid Intake Extension," 61 pages.

Final Office Action dated May 22, 2023 (9 pages), U.S. Appl. No. 17/369,526, filed Jul. 7, 2021.

Foreign Communication from Related Application—International Search Report and Written Opinion of the International Searching Authority, International Application No. PCT/US2023/025717, dated Oct. 12, 2023, 12 pages.

* cited by examiner

ELECTRIC SUBMERSIBLE PUMP (ESP) SHROUD SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point pressure, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
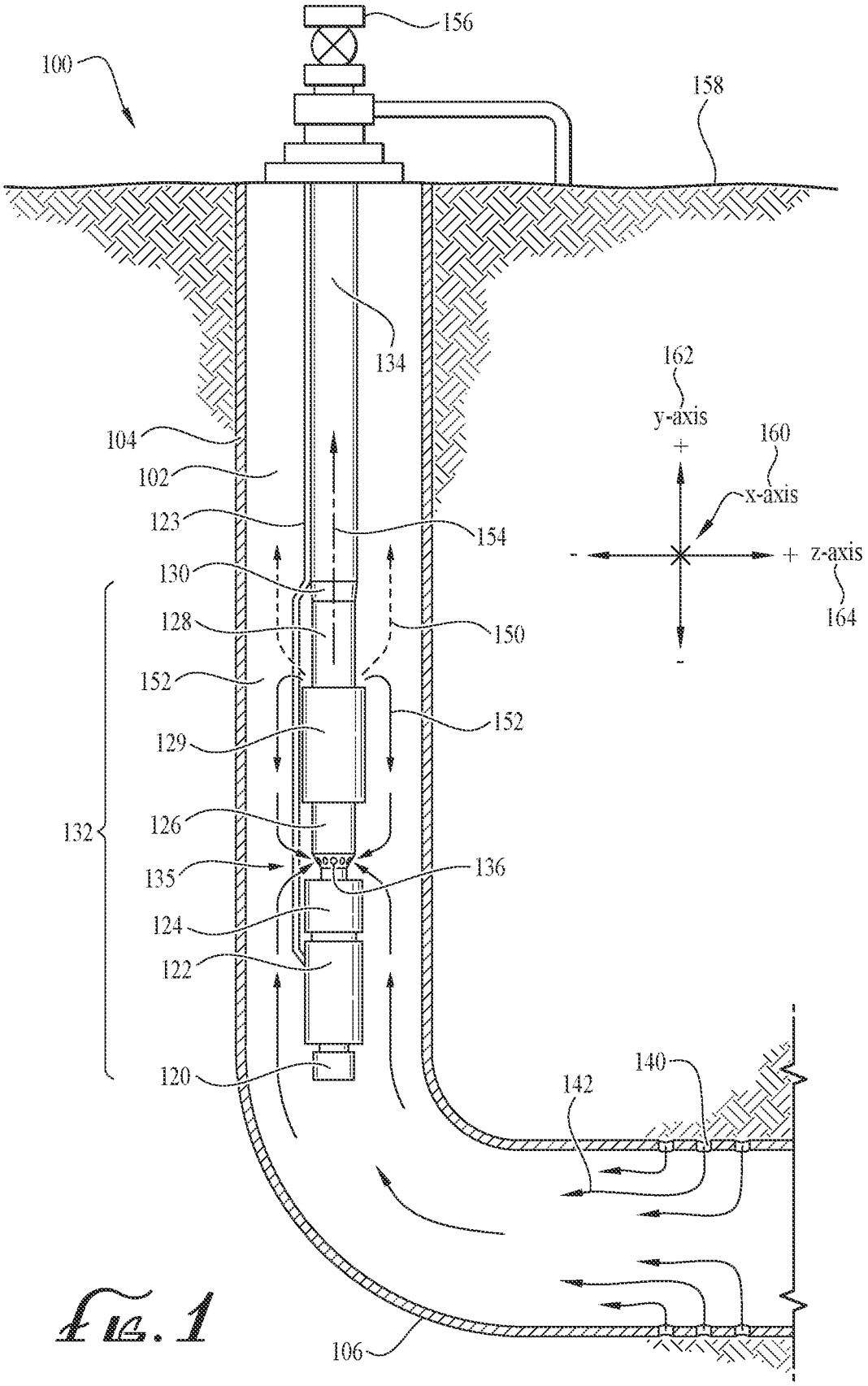
FIG. 1 is an illustration of an electric submersible pump (ESP) assembly in a wellbore at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Gas entering a centrifugal pump of an electric submersible pump (ESP) assembly can cause various difficulties for a centrifugal pump. In an extreme case, the pump may become gas locked and become unable to pump fluid. In less extreme cases, the pump may experience harmful operating conditions when transiently passing a slug of gas. When in operation, the centrifugal pump rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the centrifugal pump may heat up rapidly and undergo significant wear, shortening the operational life of the centrifugal pump, thereby increasing operating costs due to more frequent change-out and/or repair of the centrifugal pump. Down time involved in repairing or replacing the centrifugal pump may also interrupt well production undesirably. In some operating environments, for example in some horizontal wellbores, gas slugs that persist for at least 10 seconds are repeatedly experienced. Some gas slugs may persist for as much as 30 seconds or more. The present disclosure teaches a new ESP shroud system that mitigates the effects of gas slugs.

A gas separator assembly may comprise an intake that feeds reservoir fluid to a fluid mover (e.g., a paddle wheel, a rotating auger, a vortex inducer) that imparts a rotating motion to the reservoir fluid. The rotating reservoir fluid flows from the fluid mover into a separation chamber. The rotation of the reservoir fluid in the separation chamber tends to separate gas phase fluid from liquid phase fluid. Due to the rotation of the reservoir fluid, the relatively lower density gas phase fluid tends to concentrate near a centerline axis of the gas separator assembly (e.g., near a drive shaft of the gas separator assembly), and the relatively higher density liquid phase fluid tends to concentrate near an inside wall of a housing or separation chamber of the gas separator assembly. The fluid near the centerline axis enters a gas phase discharge of the gas separator assembly and exits the gas separator assembly to an annulus formed between the wellbore and the outside of the ESP assembly; the fluid near the inside wall enters a liquid phase discharge of the gas separator assembly and is directed downstream to another stage of the gas separator assembly or to an inlet of the centrifugal pump assembly. In this way the reservoir fluid that is fed downstream to the inlet of the centrifugal pump assembly may be said to be a liquid enriched reservoir fluid or a liquid enriched fraction of the reservoir fluid. In practice, fluid that is exhausted out the gas phase discharge of the gas separator assembly has a tendency to, at least in part, flow back to the fluid intake, potentially mixing gas with liquid phase fluid at the fluid intake, increasing the gas-to-liquid ratio of the fluid flowing into the fluid intake. This may be referred to as recirculation, and when a high gas-to-liquid ratio fluid is exhausted out of the gas phase discharge of the gas separator, this recirculation can be a technical problem.

As taught herein, an inverted shroud is disposed around the upper part of the gas separator assembly and extends over at least a portion of the centrifugal pump assembly. A sealing ring at the downhole end of the inverted shroud makes a seal between the inverted shroud and an outside of the gas separator assembly downhole of the gas phase discharge ports and uphole of a fluid intake located near the downhole end of the gas separator assembly. Reservoir fluid from a subterranean formation flows uphole in the wellbore, to the ESP assembly, flows in the fluid intake, and is handled by the gas separator assembly. The liquid rich portion of the separated fluid is flowed uphole to the centrifugal pump which lifts the liquid rich portion of the separated fluid to the surface. The gas rich portion of the separated fluid is flowed out the gas phase discharge ports of the gas separator assembly and into the inverted shroud. The gas rich portion of the separated fluid moves in the uphole direction inside the inverted shroud, and exits the inverted shroud at its uphole end. Some of the gas rich portion of the separated fluid may have bubbled out as gas and rises uphole in the wellbore as soon as it exits the uphole end of the inverted shroud. Some of the gas rich portion flows downhole between the annulus formed between the wellbore and the outside of the inverted shroud, continuing to bubble out gas which reverses direction and percolates uphole. Some of the gas rich portion of the fluid continues to flow back into the fluid intake and is recirculated by the gas separator assembly. But notice that this gas rich portion which flows from the uphole end of the inverted shroud back to the fluid intake has become more liquid rich as gas bubbles off. Said in another way, this fluid has changed from a higher gas-to-liquid ratio fluid to a lower gas-to-liquid ratio fluid. Additionally, the longer the path from the uphole end of the inverted shroud to the fluid intake, the more opportunity for gas to bubble out of the fluid and to achieve an increasingly lower gas-to-liquid ratio. It is generally desirable for the gas separator assembly and the centrifugal pump to receive fluid having a lower gas-to-liquid ratio.

When reservoir fluid is primarily liquid phase fluid, the gas separator assembly may exhaust primarily liquid phase fluid out of the gas phase discharge of the gas separator assembly. This primarily liquid phase fluid may fill the inverted shroud, spill over the uphole edge of the inverted shroud, flow downhole in the annulus between the inside of the wellbore and the outside of the inverted shroud and be drawn into the fluid intake along with reservoir fluid. This column of primarily liquid phase fluid (e.g., the primarily liquid phase fluid inside the inverted shroud and in the annulus between the inside of the wellbore and the outside of the inverted shroud) constitutes a reservoir that can be beneficial during a transient gas slug when the primarily liquid phase fluid that has accumulated may mix with the gas phase fluid of the gas slug at the intake to reduce the gas-to-liquid ratio of the fluid flowing into the fluid intake (that is, reduce the gas-to-liquid ratio of fluid entering the fluid intake relative to what it would be if only the gas flowing uphole from the wellbore below the electric motor were entering the fluid intake). It is noted that in this case too (e.g., the state of primarily liquid phase fluid flowing uphole past the electric motor, primarily liquid phase fluid filling the inside of the inverted shroud, and primarily liquid phase fluid filling the annulus between the inside of the wellbore and the outside of the inverted shroud), the longer or more extended the inverted shroud, the more the capacity of the ESP assembly to sustain a lengthy gas slug while drawing down the reservoir of primarily liquid phase fluid to mix with the gas of the gas slug at the fluid intake.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 has a deviated or horizontal portion 106, but the electric submersible pump (ESP) assembly 132 described herein may be used in a wellbore 102 that does not have a deviated or horizontal portion 106. The well site environment 100 may be at an on-shore location or at an off-shore location. The ESP assembly 132 in an embodiment comprises a sensor package 120, an electric motor 122, a seal unit 124, a gas separator assembly 126, and a centrifugal pump assembly 128. An inverted shroud 129 partially encloses the gas separator assembly 126 and the centrifugal pump assembly 128. The centrifugal pump assembly may couple to a production tubing 134 via a connector 130. In some context, the connector 130 may be referred to as a pump discharge.

An electric cable 123 may attach to the electric motor 122 and extend to the surface 158 to connect to an electric power source (no shown). A fluid intake 135 having a plurality of inlet ports 136 may be disposed uphole of the seal section 124 and downstream of the gas separator assembly 126. Fluid received through the inlet ports 136 of the fluid intake 135 may flow into a downhole end of the gas separator assembly 126, for example into an inlet of the gas separator assembly 126. The gas separator assembly 126 comprises gas phase discharge ports 138 (best seen in FIG. 2, FIG. 3, FIG. 4). The casing 104 and/or wellbore 102 may have perforations 140 that allow reservoir fluid 142 to pass from the subterranean formation through the perforations 140 and into the wellbore 102.

The reservoir fluid 142 may comprise hydrocarbons such as crude oil and/or natural gas. The reservoir fluid 142 may comprise hot water, for example when the wellbore 102 is a geothermal well. The reservoir fluid 142 may flow uphole towards the ESP assembly 132 and into the inlet ports 136. The reservoir fluid 142 may comprise a liquid phase fluid. The reservoir fluid 142 may comprise a gas phase fluid mixed with a liquid phase fluid. The reservoir fluid 142 may comprise only a gas phase fluid (e.g., simply gas). Over time, the gas-to-liquid ratio of the reservoir fluid 142 may change dramatically. For example, in the horizontal portion 106 of the wellbore gas may build up in high points in the roof of the wellbore 102 and after accumulating sufficiently may "burp" out of these high points and flow uphole to the ESP assembly 132 as what is commonly referred to as a gas slug. Thus, immediately before a gas slug arrives at the ESP assembly 132, the gas-to-liquid ratio of the reservoir fluid 142 may be very low (e.g., the reservoir fluid 142 at the ESP assembly 132 is mostly liquid phase fluid); when the gas slug arrives at the ESP assembly 132, the gas-to-liquid ratio is very high (e.g., the reservoir fluid 142 at the ESP assembly 132 is entirely or almost entirely gas phase fluid); and after the gas slug has passed the ESP assembly 132, the gas-to-liquid ratio may again be very low (e.g., the reservoir fluid 142 at the ESP assembly 132 is mostly liquid phase fluid).

Under normal operating conditions (e.g., reservoir fluid 142 is flowing out of the perforations 140, the ESP assembly 132 is energized by electric power, the electric motor 122 is turning, and a gas slug is not present at the fluid intake 135 of the ESP assembly 132), the reservoir fluid 142 enters the inlets 136 and the reservoir fluid 142 is separated by the gas separator assembly 138 into a gas phase fluid (or a mixed-phase fluid having a higher gas-to-liquid ratio than the reservoir fluid 142 entering the inlet ports 136) and into a liquid phase fluid (or a mixed-phase fluid having a lower gas-to-liquid ratio than the reservoir fluid 142 entering the inlet ports 136). The gas phase fluid is discharged via the gas phase discharge ports 138 into the inverted shroud 129, and the liquid phase fluid is flowed uphole to the centrifugal pump assembly 128 as liquid phase fluid 154. Under normal operating conditions, the gas phase fluid that is discharged from the inverted shroud 129 into the annulus between the casing 104 and the outside of the ESP assembly 132 may comprise both gas phase fluid 150 that rises uphole in the wellbore 102 and liquid phase fluid 152 that falls downhole in the wellbore 102. The centrifugal pump assembly 128 flows the liquid phase fluid 154 (e.g., a portion of the reservoir fluid 142) up the production tubing 134 to a wellhead 156 at the surface 158.

An orientation of the wellbore 102 and the ESP assembly 132 is illustrated in FIG. 1 by an x-axis 160, a y-axis 162, and a z-axis 164. In an embodiment, the centrifugal pump assembly 128 comprises one or more centrifugal pump stages, where each stage comprises an impeller that is mechanically coupled to a drive shaft within the centrifugal pump assembly 128 and a corresponding diffuser that is stationary and retained by a housing of the centrifugal pump assembly 128. In an embodiment, the impellers may comprise a keyway that mates with a corresponding keyway on the drive shaft of the centrifugal pump assembly 128 and a key may be installed into the two keyways, wherein the impeller may be mechanically coupled to the drive shaft of the centrifugal pump assembly.

Figure 2:
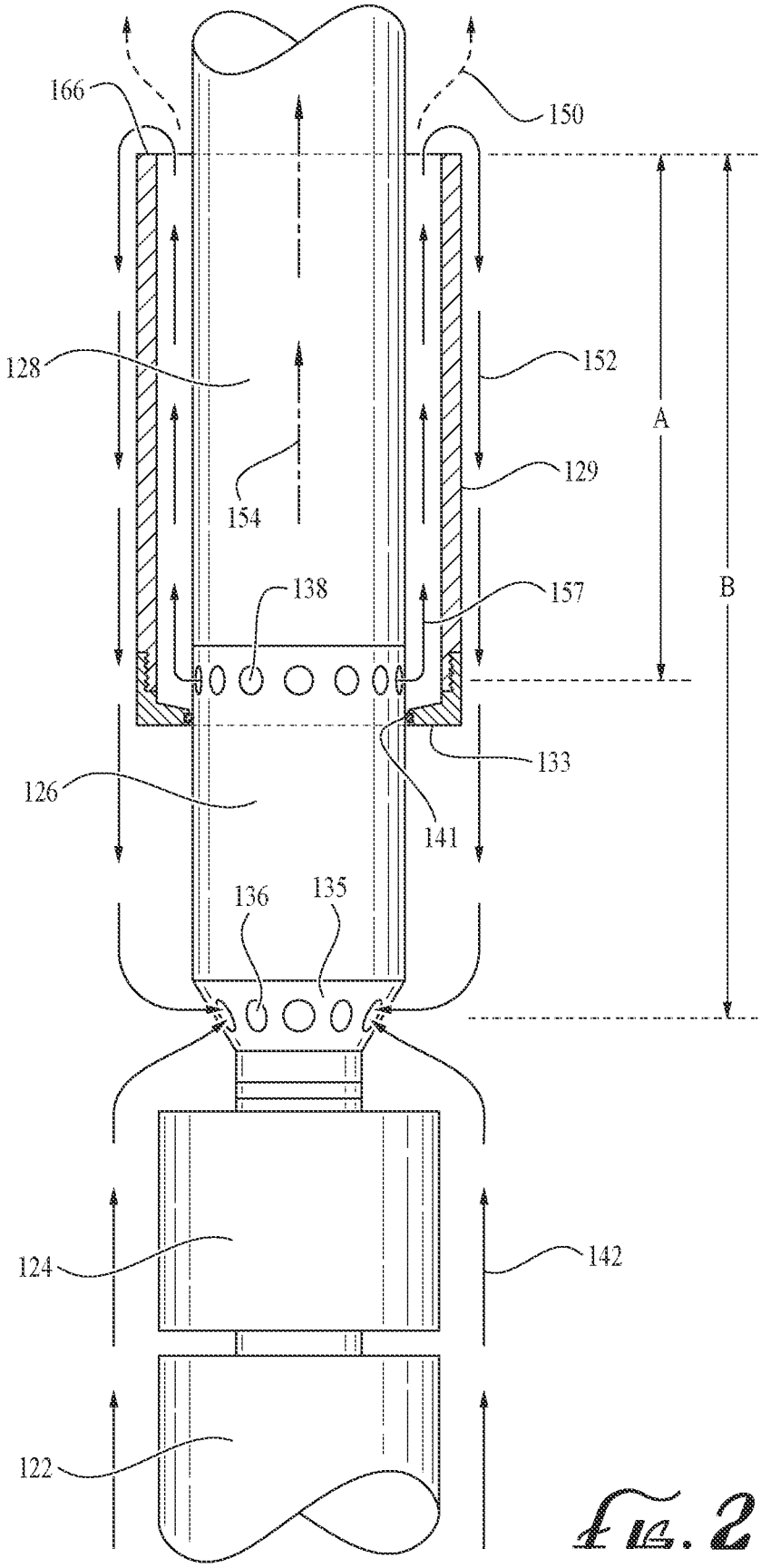
FIG. 2 is an illustration of a portion of an ESP assembly having an inverted shroud according to an embodiment of the disclosure.

Turning now to FIG. 2, further details of the ESP assembly 132 are described. In an embodiment, the inverted shroud 129 is coupled to an outside of the gas separator assembly 126 by a sealing ring 133. In an embodiment, the sealing ring 133 couples to the outside of the gas separator 126 downhole of the gas phase discharge ports 138 of the gas separator assembly 126 and uphole of the fluid intake 135. In an embodiment, an uphole end of the sealing ring 133 has female threads that mate with male threads of a tubular portion of the inverted shroud 129. In an embodiment, the uphole end of the sealing ring 133 is welded and/or bolted to the downhole end of the tubular portion of the inverted shroud 129. In an embodiment, the sealing ring 133 is all metal. In an embodiment, a portion of the sealing ring 133 comprises an elastomer 141, for example an O-ring or a gasket fitted in a circumferential groove in the sealing ring 133 or in a circumferential groove on the outside of the gas separator 126, that provides a fluid seal with the outside of the gas separator assembly 126. It will be appreciated that there need not be a perfect fluid seal between the sealing ring 133 and the outside of the gas separator assembly 126 to achieve the benefits of the inverted shroud 129 described herein. If 90% of the fluid exhausted out the gas phase discharger ports 138 flowed up the inside of the inverted shroud 129 and 10% of the exhausted fluid seeped downhole through the junction between the sealing ring 133 and the outside of the gas separator assembly 126, the benefits attributed herein to the inverted shroud 129 would still be significant.

In an embodiment, the tubular portion of the inverted shroud 129 extends uphole over a portion of an outside of the centrifugal pump assembly 128. In an embodiment the tubular portion of the inverted shroud 129 extends uphole over the outside of the centrifugal pump assembly 128 and over a lower portion of the production tubing 134. The tubular portion of the inverted shroud 129 may comprise a single continuous tubular. In an embodiment, the tubular portion of the inverted shroud 129 may comprise a plurality of continuous tubulars that are connected to each other to form a string of tubulars.

During operation of the ESP assembly 132 in the wellbore 102 during production, fluid 157 is exhausted out the gas phase discharge ports 138 of the gas separator assembly 126, the fluid 157 fills and flows uphole in the annulus formed between an inside of the inverted shroud 129 and the outside of the centrifugal pump 128. As it reaches the top of the inverted shroud 129, the fluid 157 may spill out over a lip 166 at the uphole end of the inverted shroud 129. Alternatively, in an embodiment, the uphole end of the inverted shroud 129 is secured to the outside of the centrifugal pump 128 or to an outside of the production tubing 134 by an outlet clamp, for example as illustrated in and described with reference to FIG. 5 and FIG. 5 hereinafter. As the fluid 157 reaches the top of the inverted shroud 129, it may exit via outlet ports defined in the sides of the outlet clamp.

As seen in FIG. 2, fluid 157 flows uphole in the interior of the inverted shroud 129. A first portion 152 of the fluid 157 exiting the inverted shroud 129 flows downhole to reenter the inlet ports 136 of the fluid intake 135 and a second portion 150 of the fluid 157 exiting the inverted shroud 129 flows uphole in the annulus between the inside of the wellbore 102 and the outside of the centrifugal pump 128 and/or the outside of the production tubing 134. The second portion 152 may be free gas or bubbles of gas. In an embodiment, the first portion 152 of the fluid 157 exiting the inverted shroud 129 may have a gas-to-liquid ratio that is lower than the gas-to-liquid ratio of the fluid 157 that is exhausted out the gas phase discharge ports 138. As the second portion 152 of the fluid 157 flows downhole towards the inlet ports 136 more gas may bubble free from the second portion 152 of the fluid 157 and the gas-to-liquid ratio of the second portion 152 may be lower as it enters the inlet ports 136 than when it spilled over the lip 166 at the uphole end of the inverted shroud 129 or exited an outlet of an outlet clamp at the uphole end of the inverted shroud 129.

It is noted that the longer the distance between the gas phase discharge ports 138 to the inlet ports 136, the more gas that may bubble free from the fluid 157 and from the second portion 152 of the fluid 157. This distance is the sum of (A) the distance uphole from the gas phase discharge ports 138 to the lip 166 of the inverted shroud 129 (or the outlet ports of the outlet clamp, described with reference to FIG. 5 and FIG. 6 below) and (B) the distance downhole from the lip 166 of the inverted shroud 129 to the inlet ports 136. By increasing the length of the inverted shroud 129, the distance between the gas phase discharge ports 138 to the inlet ports 136 is increased, potentially promoting more gas to bubble free from the fluid 157 and of the second portion 152 of the fluid 157 discharged from the gas phase discharge ports 138.

In an embodiment, the distance uphole from the gas phase discharge ports 138 to the lip 166 of the inverted shroud 129 (or to the outlet ports 172 of outlet clamp 170 of FIG. 5 or to the outlet ports 177 of outlet clamp 176 of FIG. 6 discussed below) is between 2 feet and 200 feet, between 4 feet and 200 feet, between 6 feet and 200 feet, between 8 feet and 200 feet, between 10 feet and 200 feet, between 12 feet and 200 feet, between 14 feet and 200 feet, between 16 feet and 200 feet, between 18 feet and 200 feet, between 20 feet and 200 feet, between 25 feet and 200 feet, between 30 feet and 200 feet, between 35 feet and 200 feet, between 40 feet and 200 feet, between 45 feet and 200 feet, between 50 feet and 200 feet. In an embodiment, the distance uphole from the gas phase discharge ports 138 to the lip 166 of the inverted shroud 129 (or to the outlet ports 172 of outlet clamp 170 of FIG. 5 or to the outlet ports 177 of outlet clamp 176 of FIG. 6 discussed below) is between 6 feet and 20 feet, between 6 feet and 25 feet, between 6 feet and 30 feet, between 6 feet and 40 feet, between 6 feet and 50 feet. In an embodiment, the distance uphole from the gas phase discharge ports 138 to the lip 166 of the inverted shroud 129 (or to the outlet ports 172 of outlet clamp 170 of FIG. 5 or to the outlet ports 177 of outlet clamp 176 of FIG. 6 discussed below) is between 8 feet and 20 feet, between 8 feet and 25 feet, between 8 feet and 30 feet, between 8 feet and 40 feet, between 68 feet and 50 feet. In an embodiment, the distance uphole from the gas phase discharge ports 138 to the lip 166 of the inverted shroud 129 (or to the outlet ports 172 of outlet clamp 170 of FIG. 5 or to the outlet ports 177 of outlet clamp 176 of FIG. 6 discussed below) is between 10 feet and 20 feet, between 10 feet and 25 feet, between 10 feet and 30 feet, between 10 feet and 40 feet, between 10 feet and 50 feet.

In some downhole operating circumstances, however, the fluid 157 flowing uphole in the inside of the inverted shroud 129 is mostly liquid. In this case, the length of the path the fluid 157 takes from the gas phase discharge ports 138 up the interior of the inverted shroud 129, down the outside of the inverted shroud 129 to the inlet ports 136 does not promote gas to bubble free from the fluid 157, because there is very little gas entrained in the fluid 157 to bubble free. Notwithstanding, the length of this path provides a benefit in this downhole operating circumstance also. This primarily liquid phase fluid (e.g., fluid 157) in the interior of the inverted shroud 129 and in the annulus between the inside of the casing 104 and the outside of the inverted shroud 129 provides a reservoir of fluid that can mix with gas flowing in from the deviated portion 106 of the wellbore 104, for example during a gas slug. This mixing of this primarily liquid phase fluid with the gas can promote the gas separator assembly 126 and the centrifugal pump 128 continuing to operate and to avoid gas lock and to avoid overheating during an extended period of time while the fluid reservoir is drawn down.

In an embodiment, the outside diameter of the inverted shroud 129 is about the same as the outside diameter of the seal section 124, and the electric cable 123 attaches to the outside of the inverted shroud 129 and the outside of the seal section 124. The outside diameter of the gas separator assembly 126 and the outside diameter of the centrifugal pump 128 are less than an inside diameter of the inverted shroud 129. In an embodiment, the seal section 124 is about 4 inches in outside diameter, and the inverted shroud 129 is about 4 inches in outside diameter. In an embodiment, the gas separator assembly 126 is about 3⅜ inches (3.38 inches) in outside diameter, and the centrifugal pump is about 3⅜ inches (3.38 inches) in outside diameter. In an embodiment, an outside diameter of the electric motor 122 is about 4⁹⁄₁₆ inches (4.562 inches). In another embodiment, however, the outside diameters of the inverted shroud 129, the seal section 124, the gas separator assembly 126, the centrifugal pump 128, and the electric motor 122 may be different.

Figure 3:
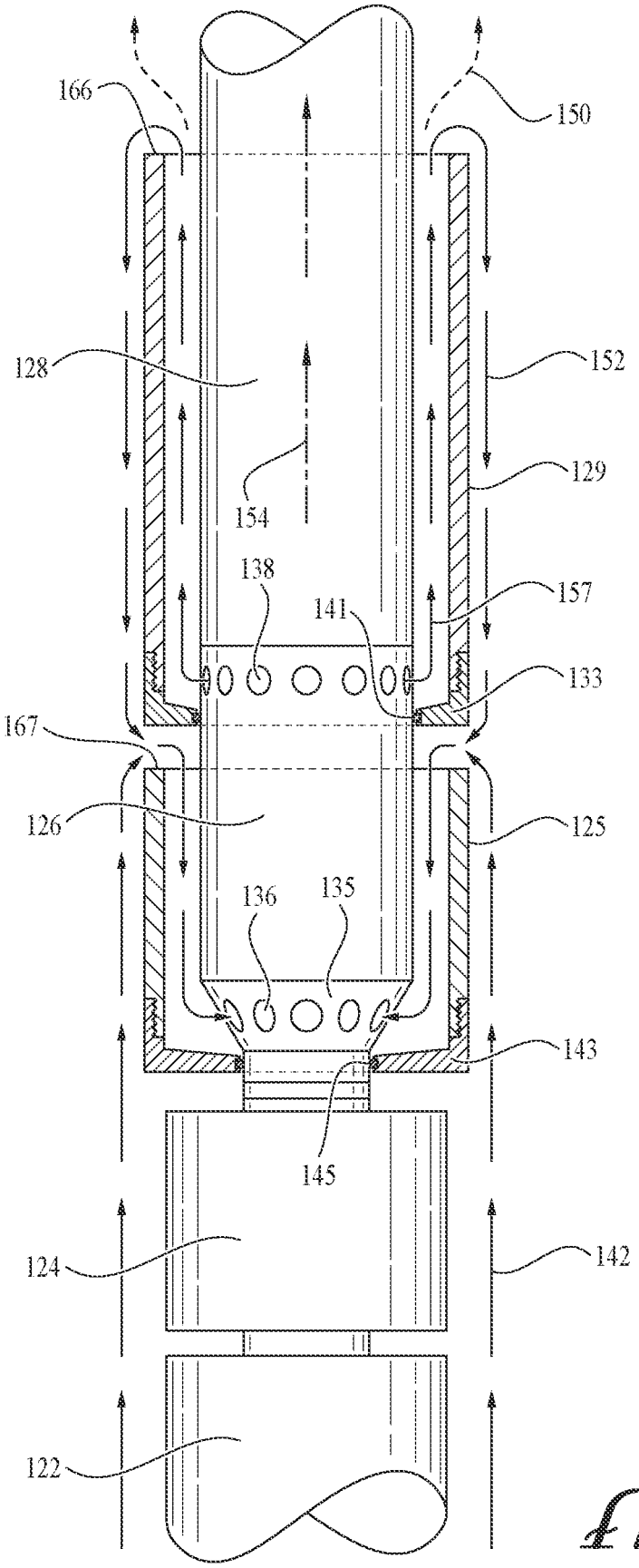
FIG. 3 is an illustration of a portion of an ESP assembly having a first inverted shroud and a second inverted shroud according to an embodiment of the disclosure.

Turning now to FIG. 3, another embodiment of the ESP assembly 132 is described that is substantially similar to the embodiment described with reference to FIG. 2 but additionally incorporates a second inverted shroud 125 that attaches at a downhole end below the fluid intake 135 and extends uphole to just below the first inverted shroud 129. In an embodiment, a second sealing ring 143 is coupled to the downhole end of the second inverted shroud 125 and attaches the second inverted shroud 125 to the outside of the fluid intake 135 below the inlet ports 136. In an embodiment, an elastomer 145 such as an O-ring or a gasket is located between the sealing ring 143 and the outside of the fluid intake 135. The fluid 142 rises in the wellbore 102 up the outside of the second inverted shroud 125, spills over an upper lip 167 of the second inverted shroud 125, and flows downhole inside of the second inverted shroud 125—along with the first portion 152 of fluid flowing downhole from the inverted shroud 129—to the inlet ports 136. In an embodiment, the uphole end of the second inverted shroud 125 is attached to the outside of the gas separator assembly 128 by an inlet clamp similar to the outlet clamp described below with reference to FIG. 5. In an embodiment, the outside diameter is about the same as the outside diameter of the inverted shroud 129.

In an embodiment, the distance from the inlet ports 136 to the upper lip 167 of the second inverted shroud 125 (or to the inlet ports 137 of the second inverted shroud as described with reference to FIG. 4 below) is from about 2 feet to 40 feet, from about 3 feet to 40 feet, from about 4 feet to 40 feet, from about 5 feet to 40 feet, from about 6 feet to 40 feet, from about 7 feet to 40 feet, from about 8 feet to 40 feet, from about 9 feet to 40 feet, from about 10 feet to 40 feet, from about 12 feet to 40 feet, from about 15 feet to 40 feet, or from about 20 feet to 40 feet. In an embodiment, the distance from the inlet ports 136 to the upper lip 167 of the second inverted shroud 125 (or to the inlet ports 137 of the second inverted shroud as described with reference to FIG. 4 below) is from about 2 feet to 10 feet, about 2 feet to 15 feet, about 2 feet to 20 feet, about 2 feet to 25 feet, about 2 feet to 30 feet, or about 2 feet to 35 feet. In an embodiment, the distance from the inlet ports 136 to the upper lip 167 of the second inverted shroud 125 (or to the inlet ports 137 of the second inverted shroud as described with reference to FIG. 4 below) is from about 4 feet to 10 feet, about 4 feet to 15 feet, 4 feet to 20 feet, 4 feet to about 25 feet, 4 feet to 30 feet, or about 4 feet to 35 feet. In an embodiment, the distance from the inlet ports 136 to the upper lip 167 of the second inverted shroud 125 (or to the inlet ports 137 of the second inverted shroud as described with reference to FIG. 4 below) is from about 6 feet to 10 feet, about 6 feet to 15 feet, about 6 feet to 20 feet, about 6 feet to 25 feet, about 6 feet to 30 feet, or about 6 feet to 35 feet. In an embodiment, the distance from the inlet ports 136 to the upper lip 167 of the second inverted shroud 125 (or to the inlet ports 137 of the second inverted shroud as described with reference to FIG. 4 below) is from about 8 feet to 15 feet, about 8 feet to 20 feet, about 8 feet to 25 feet, about 8 feet to 30 feet, or about 8 feet to 35 feet. In an embodiment, the distance from the inlet ports 136 to the upper lip 167 of the second inverted shroud 125 (or to the inlet ports 137 of the second inverted shroud as described with reference to FIG. 4 below) is from about 10 feet to 15, feet, about 10 feet to 20 feet, about 10 feet to 25 feet, about 10 feet to 30 feet, or about 10 feet to 35 feet. In an embodiment, the distance from the inlet ports 136 to the upper lip 167 of the second inverted shroud 125 (or to the inlet ports 137 of the second inverted shroud as described with reference to FIG. 4 below) is from about 15 feet to 20 feet, about 15 feet to 25 feet, about 15 feet to 30 feet, or about 15 feet to 35 feet.

Figure 4:
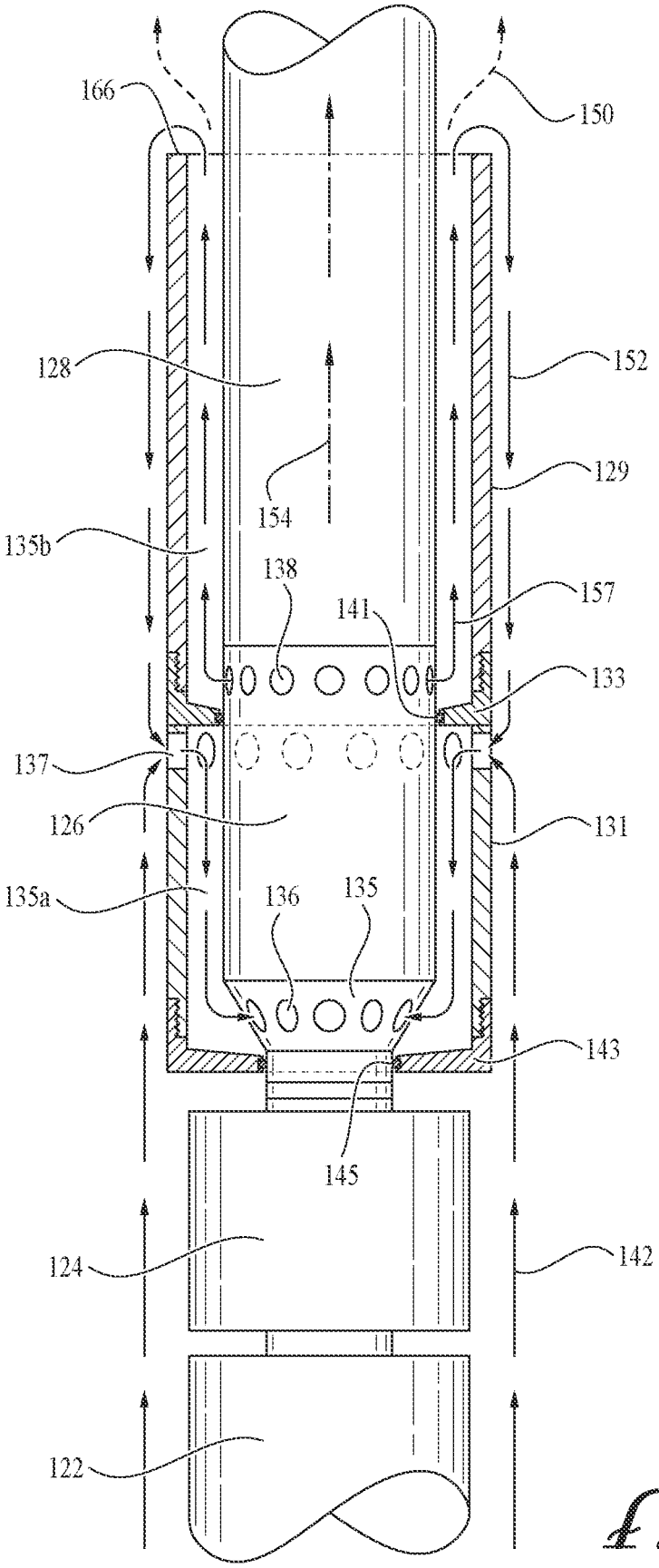
FIG. 4 is an illustration of a portion of an ESP assembly having an inverted shroud according to another embodiment of the disclosure.

Turning now to FIG. 4, another embodiment of the ESP assembly 132 is described. The embodiment of FIG. 4 shares many of the features of FIG. 3 with the significant difference that there is a third inverted shroud 131 that defines a first chamber 135*a* downhole of the sealing ring 133 and the inverted shroud 129 defines a second chamber 135*b* above the sealing ring 133. An uphole wall of the third inverted shroud 131 defines a plurality of inlet ports 137 downhole of the sealing ring 133. The structure of the inverted shroud 129 uphole of the sealing ring 133 is substantially similar to the inverted shroud 129 described above with reference to FIG. 2. The structure of the third inverted shroud 131 downhole of the sealing ring 133 provides much the same benefits of the second inverted shroud 125 described above with reference to FIG. 3. The upper end of the third inverted shroud 131 is attached to or contiguous with or is threadingly coupled to the sealing ring 133. While the inverted shroud 129 and the third inverted shroud 131 are illustrated in FIG. 4 as separate tubular sections coupled to the sealing ring 133, in an embodiment, the inverted shroud 129 and the third inverted shroud 131 may be the same tubular housing that encloses a sealing ring in its interior, where this interior sealing ring is located downhole of the gas phase discharge ports 138 of the gas separator assembly 126.

Figure 5:
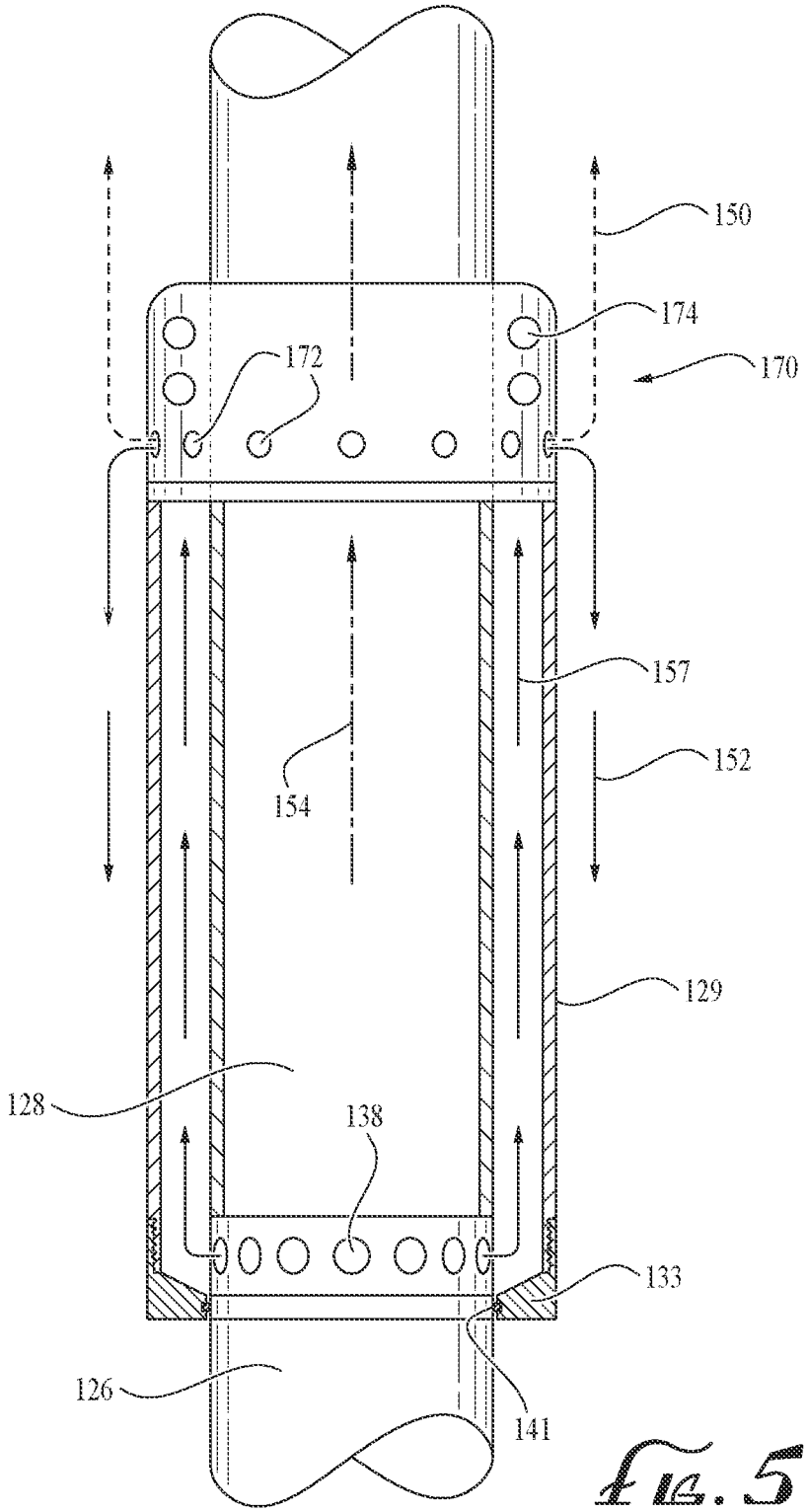
FIG. 5 is an illustration of an outlet clamp for coupling an inverted shroud to an outside of a pump of an ESP assembly according to an embodiment of the disclosure.

Turning now to FIG. 5, an outlet clamp 170 is described. In an embodiment the outlet clamp 170 is formed of two sections that mate to clamp onto an outside of the centrifugal pump 128 and clamp onto an outside of the uphole end of the inverted shroud 129 (or the inverted shroud 131). The outlet clamp 170 defines a plurality of outlet ports 172 that allow fluid flowing uphole inside the inverted shroud 129 (or flowing uphole inside the second chamber 135*b* of the inverted shroud 131 of FIG. 4) to exit. The outlet clamp 170 defines bolt holes 174 in one half and threaded holes aligned with the bolt holes 174 on the other half to receive bolts (not shown) to secure the outlet clamp 170 to an uphole end of the shroud 129 (or the uphole end of the shroud 131) and to the outside of the centrifugal pump 128.

Figure 6:
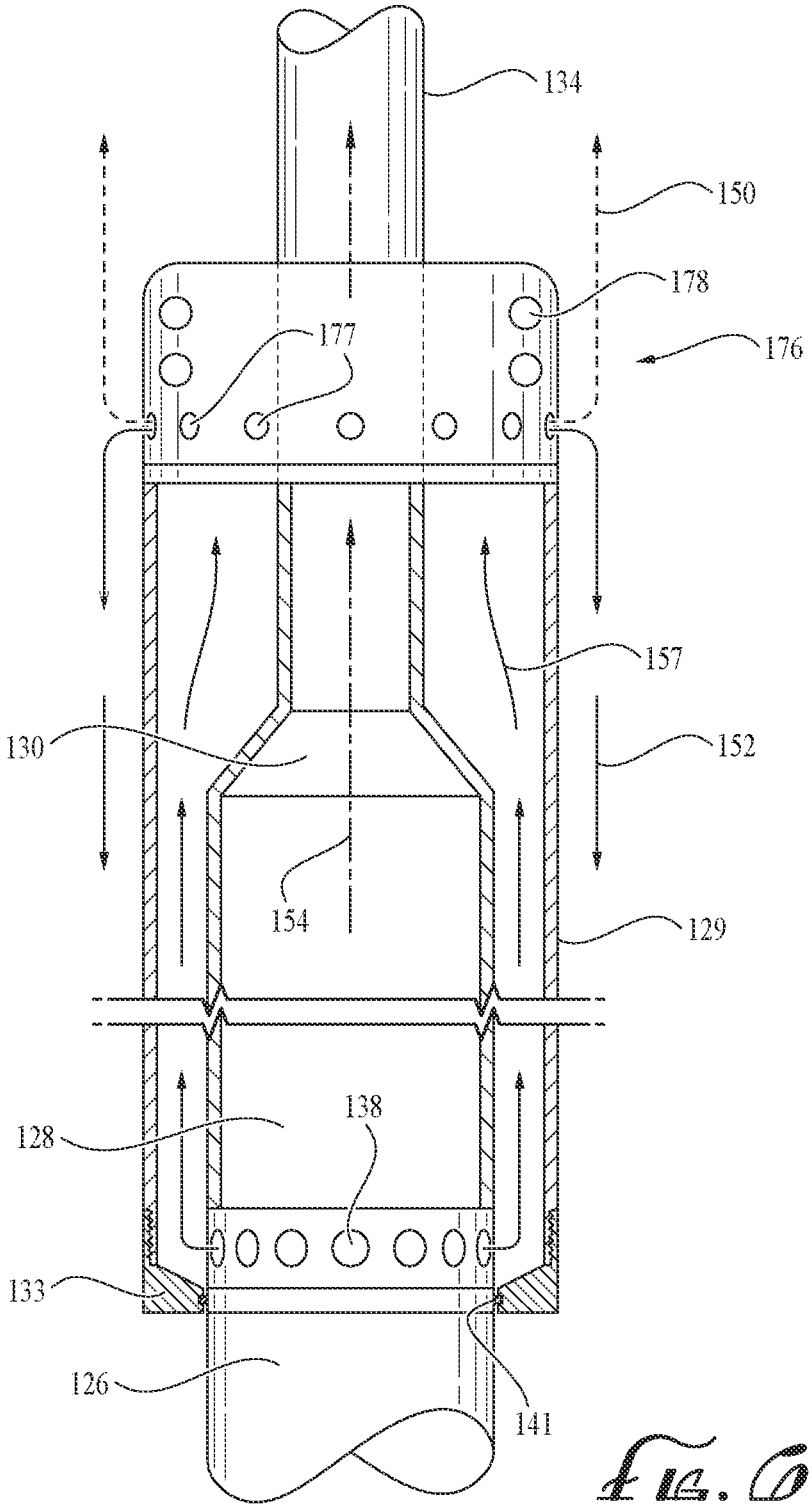
FIG. 6 is an illustration of an outlet clamp for coupling an inverted shroud to an outside of a production tubing above an ESP assembly according to an embodiment of the disclosure.

Turning now to FIG. 6, an outlet clamp 176 is described. The outlet clamp 176 is substantially similar to the outlet clamp 170 described above with reference to FIG. 5 with the difference that the outlet clamp 176 is configured to secure the upper end of the inverted shroud 129 (or the upper end of the inverted shroud 131) to an outside of the production tubing 134. In some embodiments, it may be desirable to extend the shroud 129 (or the upper chamber 135*b* of the inverted shroud 131) uphole beyond the centrifugal pump 128 and onto the production tubing 134, whereby to both extend the return path of the first fluid 152 to promote more bubbling out of gas and to increase the volume of the fluid reservoir both within the inverted shroud 129 (or within the second chamber 135*b* of the inverted shroud 131) and in the annulus formed between the outside of the inverted shroud 129 and the inside of the wellbore 102. The outlet clamp 178 defines a plurality of outlet ports 177 and a plurality of bolt holes 178 that match up to corresponding threaded holes in the other half of the outlet clamp 176.

Figure 7A:
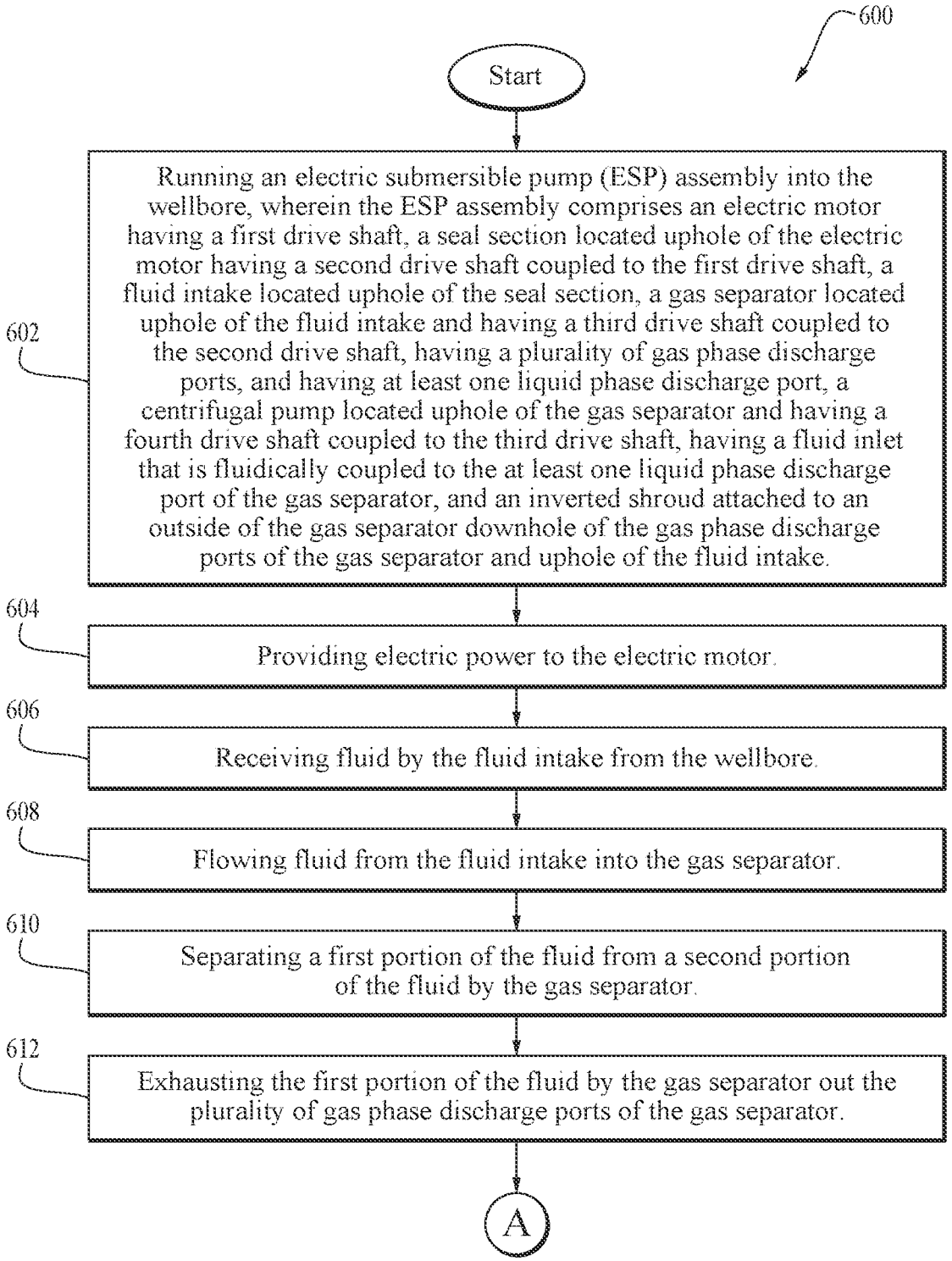
FIG. 7A and FIG. 7B is a flow chart of a method according to an embodiment of the disclosure.
Figure 7B:
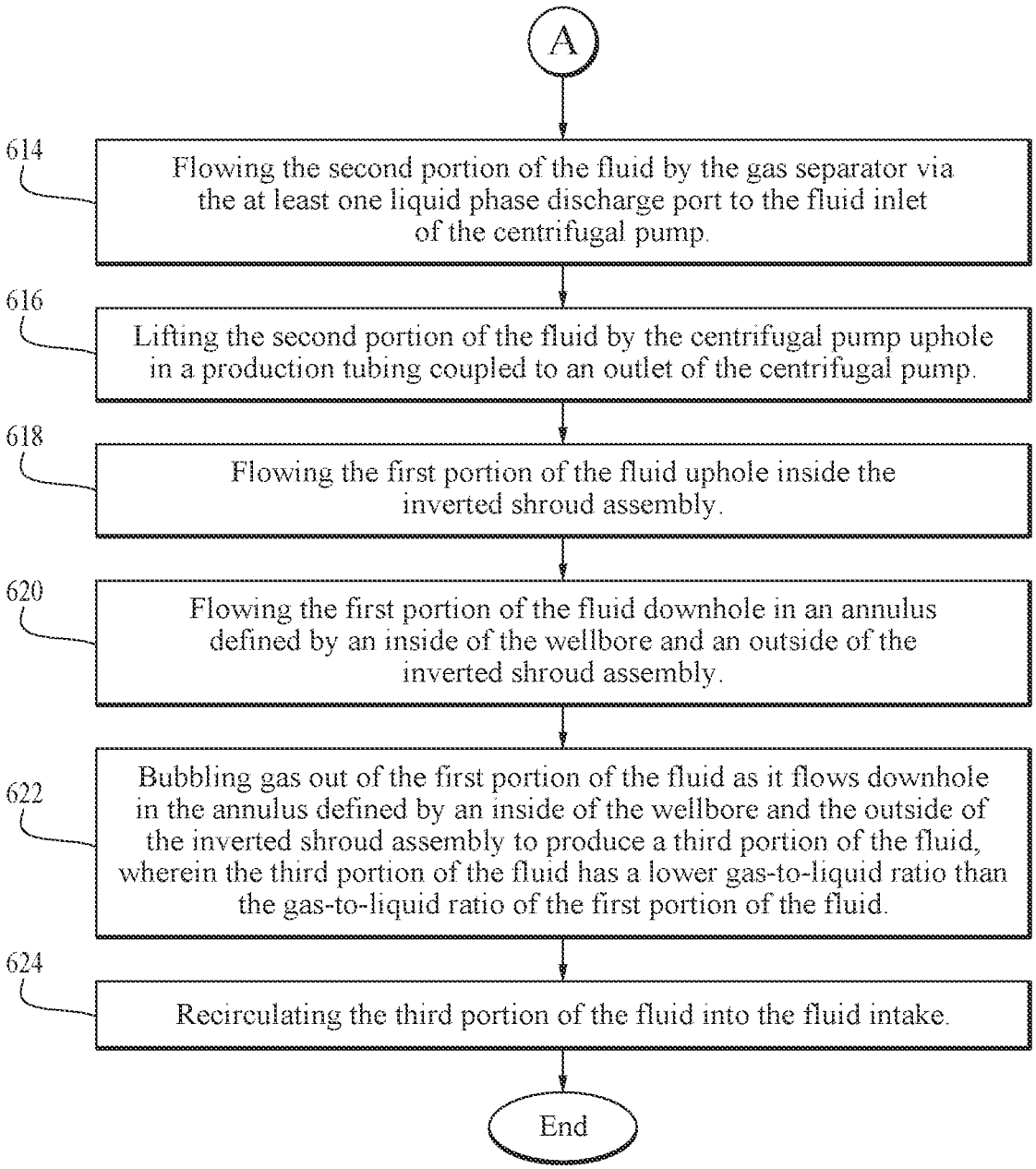

Turning now to FIG. 7, a method 600 is described. In an embodiment, the method 600 is a method of lifting fluid in a wellbore. The fluid that is lifted may be crude oil and/or crude oil mixed with gas. The fluid that is lifted may be hot water, for example when the wellbore is a geothermal well. At block 602, the method 600 comprises running an electric submersible pump (ESP) assembly into the wellbore. The ESP assembly comprises an electric motor having a first drive shaft, a seal section located uphole of the electric motor having a second drive shaft coupled to the first drive shaft, a fluid intake located uphole of the seal section, a gas separator located uphole of the fluid intake and having a third drive shaft coupled to the second drive shaft, having a plurality of gas phase discharge ports, and having at least one liquid phase discharge port, a centrifugal pump located uphole of the gas separator and having a fourth drive shaft coupled to the third drive shaft, having a fluid inlet that is fluidically coupled to the at least one liquid phase discharge port of the gas separator, and an inverted shroud attached to an outside of the gas separator downhole of the gas phase discharge ports of the gas separator and uphole of the fluid intake. In an embodiment, the ESP assembly of method 600 is the ESP assembly described above with reference to any of FIG. 1, FIG. 2, FIG. 3, FIG. 4, FIG. 5, and/or FIG. 6. In an embodiment, the outside diameter of the inverted shroud is about the same as the outside diameter of the seal section.

At block 604, the method 600 comprises providing electric power to the electric motor. At block 606, the method 600 comprises receiving fluid by the fluid intake from the wellbore. In an embodiment, the inverted shroud comprises a sealing ring that couples the inverted shroud to an outside of the gas separator downhole of the gas phase discharge ports, wherein the inverted shroud extends downhole past the gas phase discharge ports of the gas separator and couples to an outside of the fluid intake downhole of a plurality of inlet ports defined by the fluid intake, wherein the inverted shroud defines a first chamber downhole of the sealing ring and defines a second chamber uphole of the sealing ring. In an embodiment, receiving fluid by the fluid intake comprises receiving fluid into the first chamber, wherein recirculating the third portion of the fluid into the fluid intake comprises receiving the third portion of the fluid into the first chamber, and where flowing the first portion of the fluid uphole inside the inverted shroud assembly comprises flowing the first portion of the fluid uphole inside the second chamber. In an embodiment, the inverted shroud assembly defines inlet ports downhole of the sealing ring that receives the fluid and the third portion of the fluid into the first chamber.

At block 608, the method 600 comprises flowing fluid from the fluid intake into the gas separator. At block 610, the method 600 comprises separating a first portion of the fluid from a second portion of the fluid by the gas separator. At block 612, the method 600 comprises exhausting the first portion of the fluid by the gas separator out the plurality of gas phase discharge ports of the gas separator.

At block 614, the method 600 comprises flowing the second portion of the fluid by the gas separator via the at least one liquid phase discharge port to the fluid inlet of the centrifugal pump. At block 616, the method 600 comprises lifting the second portion of the fluid by the centrifugal pump uphole in a production tubing coupled to an outlet of the centrifugal pump.

At block 618, the method 600 comprises flowing the first portion of the fluid uphole inside the inverted shroud assembly. In an embodiment, the uphole end of the inverted shroud assembly is coupled to an outside of the centrifugal pump or an outside of the production tubing by an outlet clamp, and flowing the first portion of the fluid uphole inside the inverted shroud comprises flowing the first portion of the fluid out of outlet ports defined by the outlet clamp.

At block 620, the method 600 comprises flowing the first portion of the fluid downhole in an annulus defined by an inside of the wellbore and an outside of the inverted shroud assembly.

At block 622, the method 600 comprises bubbling gas out of the first portion of the fluid as it flows downhole in the annulus defined by an inside of the wellbore and the outside of the inverted shroud assembly to produce a third portion of the fluid, wherein the third portion of the fluid has a lower gas-to-liquid ratio than the gas-to-liquid ratio of the first portion of the fluid. At block 624, the method 600 comprises recirculating the third portion of the fluid into the fluid intake.

In an embodiment, the method 600 further comprises receiving a gas slug at the fluid intake; mixing the third portion of the fluid with the gas slug at the fluid intake; and flowing the mixture of the third portion of the fluid with the gas slug to the gas separator.

Figure 8A:
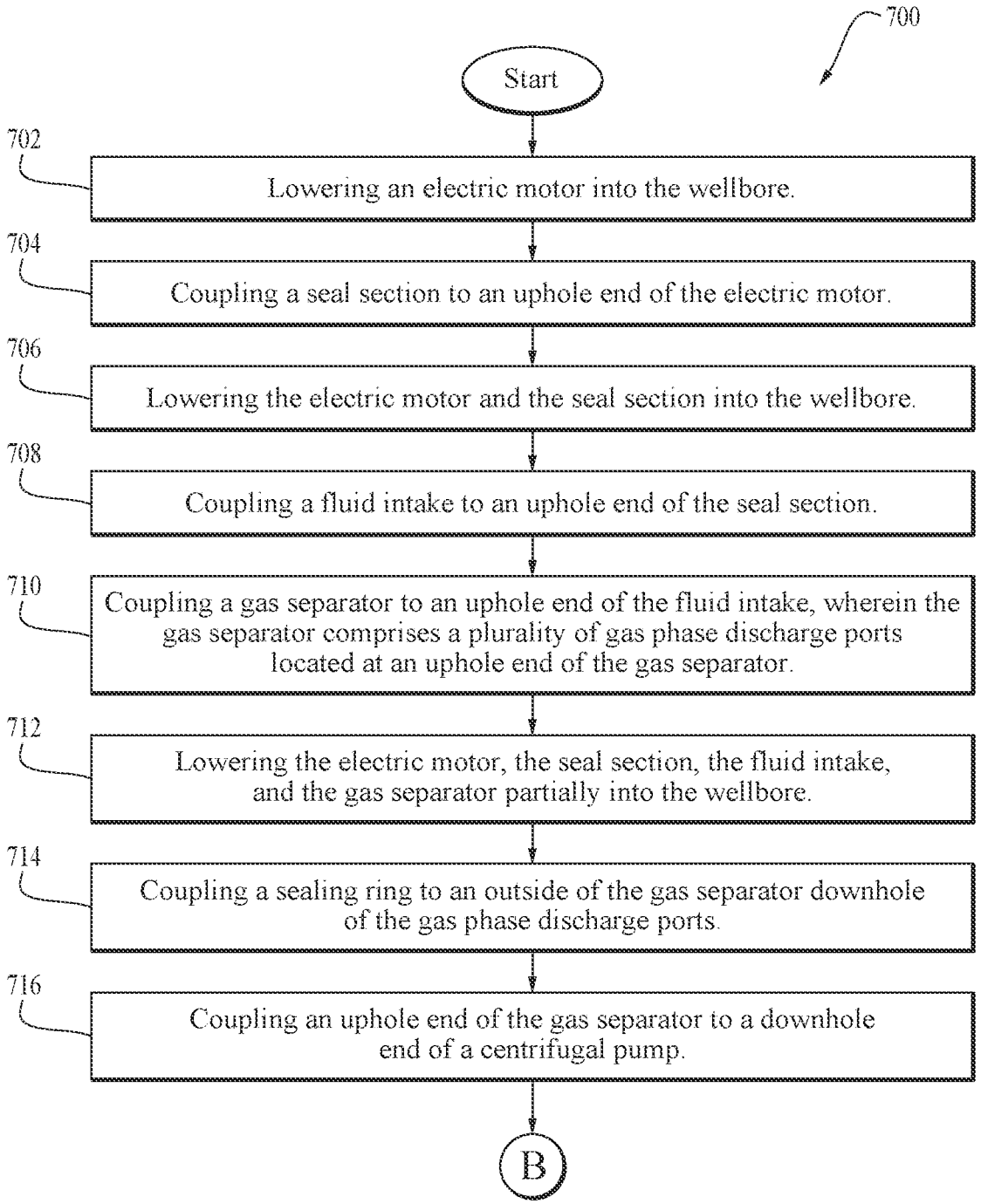
FIG. 8A and FIG. 8B are a flow chart of another method according to an embodiment of the disclosure.
Figure 8B:
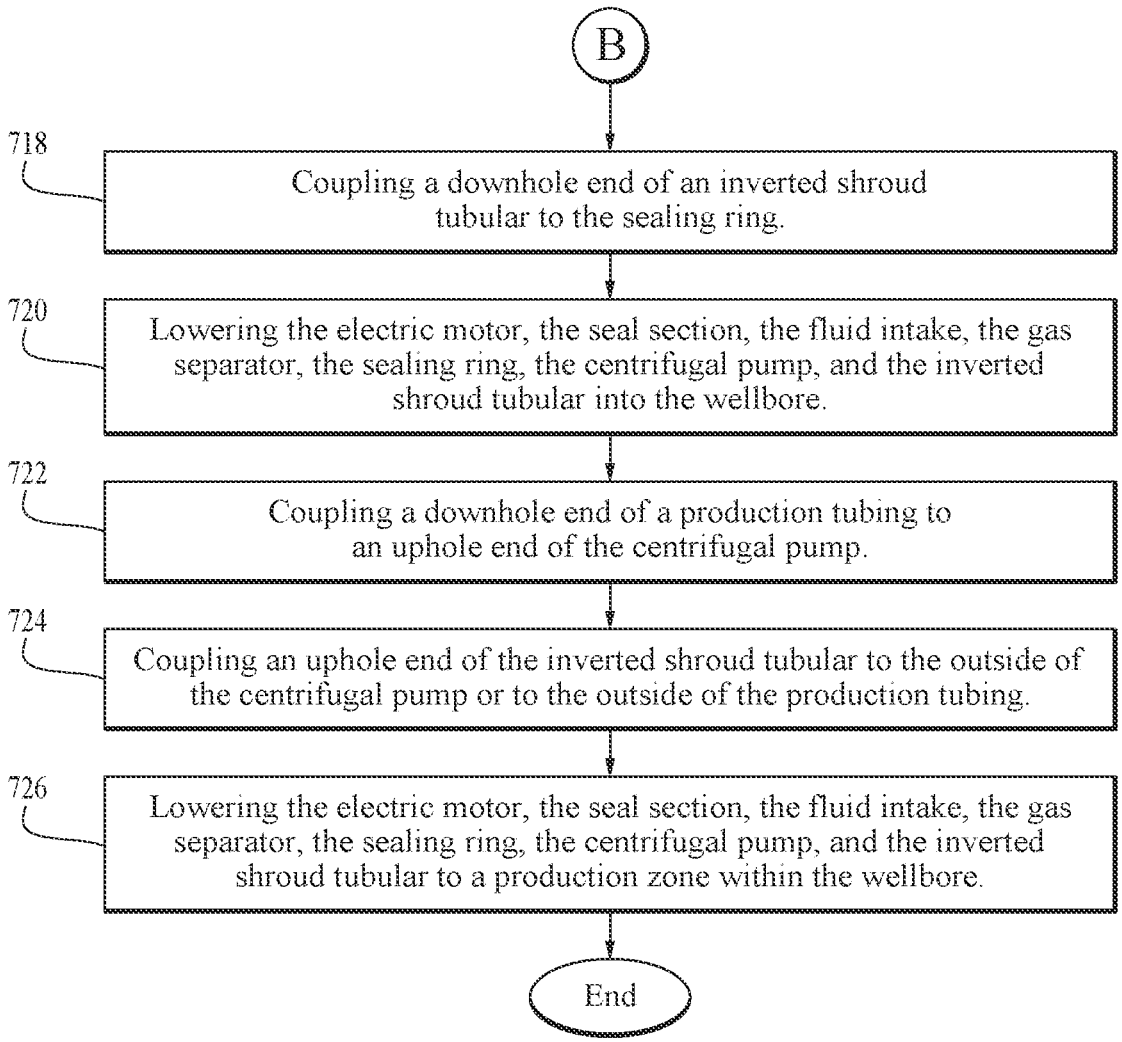

Turning now to FIG. 8, a method 700 is described. In an embodiment, the method 700 is a method of assembling an electric submersible pump (ESP) assembly. At block 702, the method 700 comprises lowering an electric motor into the wellbore.

At block 704, the method 700 comprises coupling a seal section to an uphole end of the electric motor. At block 706 the method 700 comprises lowering the electric motor and the seal section into the wellbore. At block 708, the method 700 comprises coupling a fluid intake to an uphole end of the seal section. At block 710, the method 700 comprises coupling a gas separator to an uphole end of the fluid intake, wherein the gas separator comprises a plurality of gas phase discharge ports located at an uphole end of the gas separator.

At block 712, the method 700 comprises lowering the electric motor, the seal section, the fluid intake, and the gas separator partially into the wellbore. At block 714, the method 700 comprises coupling a sealing ring to an outside of the gas separator downhole of the gas phase discharge ports. At block 716, the method 700 comprises coupling an uphole end of the gas separator to a downhole end of a centrifugal pump.

At block 718, the method 700 comprises coupling a downhole end of an inverted shroud tubular to the sealing ring. At block 720, the method 700 comprises lowering the electric motor, the seal section, the fluid intake, the gas separator, the sealing ring, the centrifugal pump, and the inverted shroud tubular into the wellbore.

At block 722, the method 700 comprises coupling a downhole end of a production tubing to an uphole end of the centrifugal pump. At block 724, the method 700 comprises coupling an uphole end of the inverted shroud tubular to the outside of the centrifugal pump or to the outside of the production tubing. At block 726, the method 700 comprises lowering the electric motor, the seal section, the fluid intake, the gas separator, the sealing ring, the centrifugal pump, and the inverted shroud tubular to a production zone within the wellbore. The production zone may be the point that the ESP assembly 132 is placed in the wellbore 102 to receive fluid 142 and to produce fluid to the surface 158. As used with reference to describing the processing of block 726, the 'production zone' need not be the location in the wellbore 102, for example the deviated portion 106 of the wellbore 102, where the perforations 140 allow fluid 142 to pass from the subterranean formations into the deviated portion 106 of the wellbore 102. Alternatively, the processing of block 726 may comprise lowering the electric motor, the seal section, the fluid intake, the gas separator, the sealing ring, the centrifugal pump, and the inverted shroud tubular to a completion depth within the wellbore.

In an embodiment, the method 700 further comprises lowering the electric motor, the seal section, the fluid intake, the gas separator, the sealing ring, the centrifugal pump, and the inverted shroud tubular to a production zone within the wellbore. In an embodiment, the method 700 further comprises coupling an uphole end of the inverted shroud tubular with an outlet clamp to an outside of the centrifugal pump. In an embodiment, the method 700 further comprises coupling an uphole end of the inverted shroud tubular with an outlet clamp to an outside of the production tubing. In an embodiment, the method 700 further comprises assembling the inverted shroud tubular by coupling a plurality of tubular sections end-to-end with each other. In an embodiment, the method 700 further comprises coupling a downhole end of a second inverted shroud to the fluid intake below the inlet ports, wherein the uphole end of the second inverted shroud is coupled to the outside of the gas separator downhole of the sealing ring, for example after performing block 708 of the method 700 and before performing block 712 of the method 700.

Additional Disclosure

The following are non-limiting, specific embodiments in accordance with the present disclosure.

A first embodiment, which is an electric submersible pump (ESP) assembly comprising an electric motor having a first drive shaft; a seal section having a second drive shaft, wherein the seal section is located uphole of the electric motor and a downhole end of the second drive shaft is coupled to an uphole end of the first drive shaft; a fluid intake located uphole of the seal section, wherein the fluid intake defines a plurality of inlet ports; a gas separator comprising a third drive shaft, a plurality of gas phase discharge ports, and at least one liquid phase discharge port, wherein the gas separator is located uphole of the fluid intake and a downhole end of the third drive shaft is coupled to an uphole end of the second drive shaft; a centrifugal pump comprising a fourth drive shaft, a fluid inlet at a downhole end of the centrifugal pump, and a plurality of pump stages, wherein the centrifugal pump is located uphole of the gas separator, the at least one liquid phase discharge port of the gas separator is fluidically coupled to the fluid inlet of the centrifugal pump, and a downhole end of the fourth drive shaft is coupled to an uphole end of the third drive shaft; and an inverted shroud assembly, wherein a downhole end of the inverted shroud assembly is coupled to an outside of the gas separator downhole of the gas phase discharge ports of the gas separator and uphole of the fluid intake.

A second embodiment, which is the ESP assembly of the first embodiment, wherein an uphole end of the inverted shroud assembly is coupled to an outside of the centrifugal pump or to an outside of a production tubing, wherein the centrifugal pump comprises a fluid outlet at an uphole end of the centrifugal pump and wherein the production tubing is coupled at a downhole end to the fluid outlet of the centrifugal pump.

A third embodiment, which is the ESP assembly of second embodiment, wherein the inverted shroud assembly is coupled to the outside of the centrifugal pump or to the outside of the production tubing by an outlet clamp.

A fourth embodiment, which is the ESP assembly of the second embodiment, wherein the inverted shroud assembly is coupled to the outside of the centrifugal pump.

A fifth embodiment, which is the ESP assembly of the second embodiment, wherein the inverted shroud assembly is coupled to the outside of the production tubing.

A sixth embodiment, which is the ESP assembly of any of the first through the fifth embodiment, further comprising a second inverted shroud assembly, wherein a downhole end of the second inverted shroud assembly is coupled to the fluid intake downhole of the inlet ports of the fluid intake and an uphole end of the second inverted shroud assembly is coupled to the outside of the gas separator downhole of the inverted shroud assembly.

A seventh embodiment, which is the ESP assembly of any of the first through the sixth embodiment, wherein the inverted shroud is coupled to the outside of the gas separator downhole of the gas phase discharge ports by a sealing ring.

An eighth embodiment, which is the ESP assembly of the seventh embodiment, wherein the sealing ring comprises an elastomer.

A ninth embodiment, which is the ESP assembly of any of the first through the eighth embodiment, wherein an outside diameter of the inverted shroud assembly is about the same as an outside diameter of the seal section.

A tenth embodiment, which is the ESP assembly of any of the first through the eighth embodiment, wherein an outside diameter of the seal section is about 4 inches, an outside diameter of the gas separator is about 3.38 inches, an outside diameter of the gas separator assembly is about 3.38 inches, an outside diameter of the centrifugal pump is about 3.38 inches, and an outside diameter of the inverted shroud is about 4 inches in diameter.

An eleventh embodiment, which is the ESP assembly of the tenth embodiment, wherein an outside diameter of the electric motor is about 4.562 inches.

A twelfth embodiment, which is the ESP assembly of any of the first through the eleventh embodiment, further comprising an electric cable that is coupled to an outside of the inverted shroud and connects at a downhole end of the electric cable to the electric motor.

A thirteenth embodiment, which is the ESP assembly of any of the second through the twelfth embodiment, wherein the inverted shroud assembly is coupled to the outside of the centrifugal pump or to the outside of the production tubing by an outlet clamp, wherein the outlet clamp comprises two mating sections that are secured to each other and to the centrifugal pump or to the production tubing by threading bolts through bolt holes in a first one of the mating sections to mate with female threads in the second one of the mating sections and wherein the outlet clamp defines outlet ports.

A fourteenth embodiment, which is an electric submersible pump (ESP) assembly, comprising an electric motor having a first drive shaft; a seal section having a second drive shaft, wherein the seal section is located uphole of the electric motor and a downhole end of the second drive shaft is coupled to an uphole end of the first drive shaft; a fluid intake located uphole of the seal section, wherein the fluid intake defines a plurality of inlet ports; a gas separator comprising a third drive shaft, a plurality of gas phase discharge ports, and at least one liquid phase discharge port, wherein the gas separator is located uphole of the fluid intake and a downhole end of the third drive shaft is coupled to an uphole end of the second drive shaft; a centrifugal pump comprising a fourth drive shaft, a fluid inlet at a downhole end of the centrifugal pump, and a plurality of pump stages, wherein the centrifugal pump is located uphole of the gas separator, the at least one liquid phase discharge port of the gas separator is fluidically coupled to the fluid inlet of the centrifugal pump, and a downhole end of the fourth drive shaft is coupled to an uphole end of the third drive shaft; and an inverted shroud assembly, wherein a downhole end of the inverted shroud assembly is coupled to an outside of the fluid intake below the inlet ports defined by the fluid intake, wherein an uphole end of the inverted shroud assembly is coupled to an outside of the centrifugal pump assembly or to an outside of a production tubing that is coupled at a downhole end to an uphole end of the centrifugal pump assembly, and wherein a central portion of the inverted shroud assembly is coupled to an outside of the gas separator assembly by a sealing ring that is located downhole of the gas phase discharge ports and upstream of the fluid intake.

A fifteenth embodiment, which is a method of lifting fluid in a wellbore, comprising running an electric submersible pump (ESP) assembly into the wellbore, wherein the ESP assembly comprises an electric motor having a first drive shaft, a seal section located uphole of the electric motor having a second drive shaft coupled to the first drive shaft, a fluid intake located uphole of the seal section, a gas separator located uphole of the fluid intake and having a third drive shaft coupled to the second drive shaft, having a plurality of gas phase discharge ports, and having at least one liquid phase discharge port, a centrifugal pump located uphole of the gas separator and having a fourth drive shaft coupled to the third drive shaft, having a fluid inlet that is fluidically coupled to the at least one liquid phase discharge port of the gas separator, and an inverted shroud coupled to an outside of the gas separator downhole of the gas phase discharge ports of the gas separator and uphole of the fluid intake; providing electric power to the electric motor; receiving fluid by the fluid intake from the wellbore; flowing fluid from the fluid intake into the gas separator; separating a first portion of the fluid from a second portion of the fluid by the gas separator; exhausting the first portion of the fluid by the gas separator out the plurality of gas phase discharge ports of the gas separator; flowing the second portion of the fluid by the gas separator via the at least one liquid phase discharge port to the fluid inlet of the centrifugal pump; lifting the second portion of the fluid by the centrifugal pump uphole in a production tubing coupled to an outlet of the centrifugal pump; flowing the first portion of the fluid uphole inside the inverted shroud assembly; flowing the first portion of the fluid downhole in an annulus defined by an inside of the wellbore and an outside of the inverted shroud assembly; bubbling gas out of the first portion of the fluid as it flows downhole in the annulus defined by an inside of the wellbore and the outside of the inverted shroud assembly to produce a third portion of the fluid, wherein the third portion of the fluid has a lower gas-to-liquid ratio than the gas-to-liquid ratio of the first portion of the fluid; and recirculating the third portion of the fluid into the fluid intake.

A sixteenth embodiment, which is a method of lifting fluid in a wellbore, comprising running an electric submersible pump (ESP) assembly according to any of the first through the fourteenth embodiment into the wellbore; providing electric power to the electric motor; receiving fluid by the fluid intake from the wellbore; flowing fluid from the fluid intake into the gas separator; separating a first portion of the fluid from a second portion of the fluid by the gas separator; exhausting the first portion of the fluid by the gas separator out the plurality of gas phase discharge ports of the gas separator; flowing the second portion of the fluid by the gas separator via the at least one liquid phase discharge port to the fluid inlet of the centrifugal pump; lifting the second portion of the fluid by the centrifugal pump uphole in a production tubing coupled to an outlet of the centrifugal pump; flowing the first portion of the fluid uphole inside the inverted shroud assembly; flowing the first portion of the fluid downhole in an annulus defined by an inside of the wellbore and an outside of the inverted shroud assembly; bubbling gas out of the first portion of the fluid as it flows downhole in the annulus defined by an inside of the wellbore and the outside of the inverted shroud assembly to produce a third portion of the fluid, wherein the third portion of the fluid has a lower gas-to-liquid ratio than the gas-to-liquid ratio of the first portion of the fluid; and recirculating the third portion of the fluid into the fluid intake.

A seventeenth embodiment, which is the method of the fifteenth or sixteenth embodiment, further comprising receiving a gas slug at the fluid intake; mixing the third portion of the fluid with the gas slug at the fluid intake; and flowing the mixture of the third portion of the fluid with the gas slug to the gas separator.

An eighteenth embodiment, which is the method of any of the fifteenth through the seventeenth embodiment, wherein the inverted shroud comprises a sealing ring that couples the inverted shroud to an outside of the gas separator downhole of the gas phase discharge ports, wherein the inverted shroud extends downhole past the gas phase discharge ports of the gas separator and couples to an outside of the fluid intake downhole of a plurality of inlet ports defined by the fluid intake, wherein the inverted shroud defines a first chamber downhole of the sealing ring and defines a second chamber uphole of the sealing ring.

A nineteenth embodiment, which is the method of the eighteenth embodiment, wherein receiving fluid by the fluid intake comprises receiving fluid into the first chamber, wherein recirculating the third portion of the fluid into the fluid intake comprises receiving the third portion of the fluid into the first chamber, and where flowing the first portion of the fluid uphole inside the inverted shroud assembly comprises flowing the first portion of the fluid uphole inside the second chamber.

A twentieth embodiment, which is the method of the nineteenth embodiment, wherein the inverted shroud assembly defines inlet ports downhole of the sealing ring that receives the fluid and the third portion of the fluid into the first chamber.

A twenty-first embodiment, which is the method of any of the fifteenth through the twentieth embodiment, wherein the uphole end of the inverted shroud assembly is coupled to an outside of the centrifugal pump or an outside of the production tubing by an outlet clamp, and wherein flowing the first portion of the fluid uphole inside the inverted shroud comprises flowing the first portion of the fluid out of outlet ports defined by the outlet clamp.

A twenty-second embodiment, which is the method of any of the fifteenth through the twenty-first embodiment, wherein the outside diameter of the inverted shroud is about the same as the outside diameter of the seal section.

A twenty-third embodiment, which is a method of assembling an electric submersible pump (ESP) assembly, comprising lowering an electric motor into the wellbore; coupling a seal section to an uphole end of the electric motor; lowering the electric motor and the seal section into the wellbore; coupling a fluid intake to an uphole end of the seal section, wherein the fluid intake defines a plurality of inlet ports; coupling a gas separator to an uphole end of the fluid intake, wherein the gas separator comprises a plurality of gas phase discharge ports located at an uphole end of the gas separator; lowering the electric motor, the seal section, the fluid intake, and the gas separator partially into the wellbore; coupling a sealing ring to an outside of the gas separator downhole of the gas phase discharge ports; coupling an uphole end of the gas separator to a downhole end of a centrifugal pump; coupling a downhole end of an inverted shroud tubular to the sealing ring; lowering the electric motor, the seal section, the fluid intake, the gas separator, the sealing ring, the centrifugal pump, and the inverted shroud tubular into the wellbore; coupling a downhole end of a production tubing to an uphole end of the centrifugal pump; and coupling an uphole end of the inverted shroud tubular to the outside of the centrifugal pump or to the outside of the production tubing.

A twenty-fourth embodiment, which is the method of the twenty-third embodiment, further comprising lowering the electric motor, the seal section, the fluid intake, the gas separator, the sealing ring, the centrifugal pump, and the inverted shroud tubular to a completion depth within the wellbore.

A twenty-fifth embodiment, which is the method of the twenty-third or the twenty-fourth embodiment, further comprising coupling a downhole end of a second inverted shroud to the fluid intake downhole of the inlet ports, wherein the uphole end of the second inverted shroud is coupled to the outside of the gas separator downhole of the sealing ring.

A twenty-sixth embodiment, which is the method of any of the twenty-third through the twenty-fifth embodiment, further comprising coupling an uphole end of the inverted shroud tubular with an outlet clamp to an outside of the centrifugal pump.

A twenty-seventh embodiment, which is the method of any of the twenty-third through the twenty-fifth embodiment, further comprising coupling an uphole end of the inverted shroud tubular with an outlet clamp to an outside of the production tubing.

A twenty-eighth embodiment, which is the method of any of the twenty-third through the twenty-seventh embodiment, further comprising assembling the inverted shroud tubular by coupling a plurality of tubular sections end-to-end with each other.

A twenty-ninth embodiment, which is the method of any of the twenty-first through the twenty-eighth embodiment, further comprising coupling a second inverted shroud tubular at a downhole end to an outside of the fluid intake downhole of the inlet ports defined by the fluid intake and coupling the second inverted shroud tubular at an uphole end to an outside of the gas separator downhole of the gas phase discharge ports.

A method of assembling an electric submersible pump (ESP) assembly, comprising lowering an electric motor into the wellbore; coupling a seal section to an uphole end of the electric motor; lowering the electric motor and the seal section into the wellbore; coupling a fluid intake to an uphole end of the seal section, wherein the fluid intake defines a plurality of inlet ports; coupling a downhole end of a first section of an inverted shroud tubular to an outside of the fluid intake downhole of the inlet ports defined by the fluid intake; coupling a gas separator to an uphole end of the fluid intake, wherein the gas separator comprises a plurality of gas phase discharge ports located at an uphole end of the gas separator; lowering the electric motor, the seal section, the fluid intake, the first section of the inverted shroud tubular, and the gas separator partially into the wellbore; coupling an uphole end of the first section of the inverted shroud tubular to a sealing ring; coupling the sealing ring to an outside of the gas separator downhole of the gas phase discharge ports; coupling an uphole end of the gas separator to a downhole end of a centrifugal pump; coupling a downhole end of a second section of the inverted shroud tubular to the sealing ring; lowering the electric motor, the seal section, the fluid intake, the first section of the inverted shroud tubular, the gas separator, the sealing ring, the centrifugal pump, and the second section of the inverted shroud tubular into the wellbore; coupling a downhole end of a production tubing to an uphole end of the centrifugal pump; and coupling an uphole end of the second section of the inverted shroud tubular to the outside of the centrifugal pump or to the outside of the production tubing.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. As the fluid 142 reverses direction and travels downwards inside the second inverted shroud 125, gas entrained in the fluid 142 may bubble free and exit out the top of the second inverted shroud, thereby enriching the liquid content of the fluid entering the inlet ports 136 (e.g., lowering a gas-to-liquid ratio of the fluid entering the inlet ports 136).

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

an electric motor having a first drive shaft;

a seal section having a second drive shaft, wherein the seal section is located uphole of the electric motor and a downhole end of the second drive shaft is coupled to an uphole end of the first drive shaft;

a fluid intake located uphole of the seal section, wherein the fluid intake defines a plurality of inlet ports;

a gas separator comprising a third drive shaft, a plurality of gas phase discharge ports, and at least one liquid phase discharge port, wherein the gas separator is located uphole of the fluid intake and a downhole end of the third drive shaft is coupled to an uphole end of the second drive shaft;

a centrifugal pump comprising a fourth drive shaft, a fluid inlet at a downhole end of the centrifugal pump, and a plurality of pump stages, wherein the centrifugal pump is located uphole of the gas separator, the at least one liquid phase discharge port of the gas separator is fluidically coupled to the fluid inlet of the centrifugal pump, and a downhole end of the fourth drive shaft is coupled to an uphole end of the third drive shaft; and an inverted shroud assembly, wherein a downhole end of the inverted shroud assembly is coupled to an outside of the gas separator downhole of the gas phase discharge ports of the gas separator and uphole of the fluid intake.

2. The ESP assembly of claim 1, wherein an uphole end of the inverted shroud assembly is coupled to an outside of the centrifugal pump or to an outside of a production tubing, wherein the centrifugal pump comprises a fluid outlet at an uphole end of the centrifugal pump and wherein the production tubing is coupled at a downhole end to the fluid outlet of the centrifugal pump.

3. The ESP assembly of claim 2, wherein the inverted shroud assembly is coupled to the outside of the centrifugal pump or to the outside of the production tubing by an outlet clamp.

4. The ESP assembly of claim 1, further comprising a second inverted shroud assembly, wherein a downhole end of the second inverted shroud assembly is coupled to the fluid intake downhole of the inlet ports of the fluid intake and an uphole end of the second inverted shroud assembly is coupled to the outside of the gas separator downhole of the inverted shroud assembly.

5. The ESP assembly of claim 1, wherein the inverted shroud is coupled to the outside of the gas separator downhole of the gas phase discharge ports by a sealing ring.

6. The ESP assembly of claim 5, wherein the sealing ring comprises an elastomer.

7. The ESP assembly of claim 1, wherein an outside diameter of the inverted shroud assembly is about the same as an outside diameter of the seal section.

8. A method of assembling an electric submersible pump (ESP) assembly, comprising:

lowering an electric motor into the wellbore;

coupling a seal section to an uphole end of the electric motor;

lowering the electric motor and the seal section into the wellbore;

coupling a fluid intake to an uphole end of the seal section, wherein the fluid intake defines a plurality of inlet ports;

coupling a gas separator to an uphole end of the fluid intake, wherein the gas separator comprises a plurality of gas phase discharge ports located at an uphole end of the gas separator;

lowering the electric motor, the seal section, the fluid intake, and the gas separator partially into the wellbore;

coupling a sealing ring to an outside of the gas separator downhole of the gas phase discharge ports;

coupling an uphole end of the gas separator to a downhole end of a centrifugal pump;

coupling a downhole end of an inverted shroud tubular to the sealing ring;

lowering the electric motor, the seal section, the fluid intake, the gas separator, the sealing ring, the centrifugal pump, and the inverted shroud tubular into the wellbore;

coupling a downhole end of a production tubing to an uphole end of the centrifugal pump; and coupling an uphole end of the inverted shroud tubular to the outside of the centrifugal pump or to the outside of the production tubing.

9. The method of claim 8, further comprising lowering the electric motor, the seal section, the fluid intake, the gas separator, the sealing ring, the centrifugal pump, and the inverted shroud tubular to a completion depth within the wellbore.

10. The method of claim 8, further comprising coupling a downhole end of a second inverted shroud to the fluid intake downhole of the inlet ports, wherein the uphole end of the second inverted shroud is coupled to the outside of the gas separator downhole of the sealing ring.

11. The method of claim 8, further comprising coupling an uphole end of the inverted shroud tubular with an outlet clamp to an outside of the centrifugal pump.

12. The method of claim 8, further comprising coupling an uphole end of the inverted shroud tubular with an outlet clamp to an outside of the production tubing.

13. The method of claim 8, further comprising assembling the inverted shroud tubular by coupling a plurality of tubular sections end-to-end with each other.

* * * * *